US007168883B2

(12) United States Patent
Waterford

(10) Patent No.: US 7,168,883 B2
(45) Date of Patent: Jan. 30, 2007

(54) TENNIS SURFACE

(75) Inventor: Gary Wayne Waterford, Rose Bay (AU)

(73) Assignee: Grass Manufacturers Pty Ltd, Botany (AU)

( * ) Notice: Subject to any disclaimer, the term of this patent is extended or adjusted under 35 U.S.C. 154(b) by 0 days.

(21) Appl. No.: 10/472,285

(22) PCT Filed: Mar. 21, 2002

(86) PCT No.: PCT/AU02/00330

§ 371 (c)(1),
(2), (4) Date: Sep. 17, 2003

(87) PCT Pub. No.: WO02/075054

PCT Pub. Date: Sep. 26, 2002

(65) Prior Publication Data

US 2004/0096274 A1 May 20, 2004

(30) Foreign Application Priority Data

Mar. 21, 2001 (AU) ..... PR3880

(51) Int. Cl.
*E01C 13/00* (2006.01)

(52) U.S. Cl. ..... 404/17; 404/71; 428/17; 428/87

(58) Field of Classification Search ..... 404/17, 404/27, 28, 71; 428/87, 95, 17
See application file for complete search history.

(56) References Cited

U.S. PATENT DOCUMENTS

| | | | | |
|---|---|---|---|---|
| 3,837,980 | A | 9/1974 | Nishimura et al. | 428/17 |
| 3,940,522 | A | 2/1976 | Wessells | 428/17 |
| 4,336,286 | A | 6/1982 | Tomarin | 428/17 |
| 4,396,653 | A * | 8/1983 | Tomarin | 428/17 |
| 4,637,942 | A | 1/1987 | Tomarin | 428/17 |
| 4,755,401 | A * | 7/1988 | Friedrich et al. | 428/17 |
| 5,601,886 | A * | 2/1997 | Ishikawa et al. | 428/17 |
| 5,850,708 | A * | 12/1998 | Bergevin | 47/1.01 R |
| 6,048,282 | A * | 4/2000 | Prevost et al. | 473/490 |
| 6,145,248 | A * | 11/2000 | Bergevin | 47/58.1 R |
| 6,216,389 | B1 * | 4/2001 | Motz et al. | 47/58.1 R |
| 6,227,989 | B1 * | 5/2001 | Reid | 473/490 |
| 6,472,041 | B1 * | 10/2002 | Burke | 428/86 |
| 6,527,889 | B1 * | 3/2003 | Paschal et al. | 156/72 |

FOREIGN PATENT DOCUMENTS

| | | |
|---|---|---|
| AU | 54901/90 | 5/1989 |
| AU | 21155/92 | 8/1992 |
| DE | 4304711 | 2/1993 |
| EP | A0 174 755 | 8/1985 |
| EP | 1178155 A1 | 2/2002 |

(Continued)

*Primary Examiner*—Gary S. Hartmann
(74) *Attorney, Agent, or Firm*—Gordon & Jacobson, PC

(57) ABSTRACT

A simulated clay tennis surface has a first region tufted with synthetic ribbons of a first height, and a second region tufted with synthetic ribbons higher than those of the first region. A granular infill material is applied to a depth which covers the ribbons in the first region, but leaves the tips of the ribbons of the second region visible to form court markings of a contrasting color to the infill material.

13 Claims, 1 Drawing Sheet

FOREIGN PATENT DOCUMENTS

| | | | |
|---|---|---|---|
| FR | 2616674 | | 6/1987 |
| FR | 2618345 | A1 | 7/1987 |
| FR | 2633844 | | 7/1988 |
| GB | 2087959 | | 4/1981 |
| GB | 2 253 638 | A | 9/1992 |
| JP | 07317010 | | 3/1991 |
| JP | 07317011 | | 3/1991 |
| JP | 09203007 | | 9/1996 |
| JP | 09100509 | A | 4/1997 |
| JP | 09217311 | A | 8/1997 |
| JP | 09273107 | A | 10/1997 |
| JP | 09273108 | A | 10/1997 |
| JP | 10204815 | A | 8/1998 |
| JP | 11093112 | A | 4/1999 |
| JP | 11107207 | A1 | 4/1999 |
| JP | 2000-192411 | * | 7/2000 |
| JP | 2004-92111 | * | 3/2004 |
| WO | WO 92/05317 | | 4/1992 |
| WO | WO 94/18393 | | 1/1994 |
| WO | WO 98/40559 | | 3/1998 |
| WO | WO 01/05257 | | 7/2000 |
| WO | WO 01/48322 | A1 | 7/2001 |
| WO | WO 02/075053 | | 9/2002 |

* cited by examiner

TENNIS SURFACE

BACKGROUND OF THE INVENTION

1. Field of the Ivention

The present invention relates to a synthetic sports surface adapted to simulate a claycourt tennis surface.

2. State of the Art

The sport of tennis may be played on many different court types, for example lawn, rubberised surfaces, clay or hard-court. Each of these surfaces has intrinsic characteristics of bounce, speed and slide, which differ significantly between the court types. Synthetic turf courts simulating lawn are well known.

Such synthetic turf courts are formed as a flexible backing sheet into which is stitched (tufted) parallel rows of synthetic ribbons which extend upwards of the backing sheet to simulate blades of grass. A backing layer, such as latex, may be applied to the back of the backing sheet.

A particulate material, such as layers of sand or crumbed rubber, is used as an infill material between the ribbons, to hold the ribbons generally upright and to provide resilience to the sports surface. In synthetic turf surfaces, the infill level extends to a short distance below the tips of the ribbons, so that the exposed ribbon tips resemble the appearance and playing characteristics of grass.

The present applicants have found that it is possible to simulate the playing characteristics of a clay tennis surface by means of a synthetic turf surface which is overfilled so that a layer of the granular infill material covers the tips of the synthetic pile. Furthermore, by appropriate colouring the infill material, the appearance of a clay court can also by simulated.

The applicants have found however that the techniques and materials used in conventional synthetic turf may have surprising, and sometimes contrary, effects when applied to these simulated clay courts, and therefore that a construction optimal for a conventional synthetic turf court surface may not be optimal for simulated clay. In particular, the applicant has found that a relatively long (e.g. 15 mm), straight pile at close spacing—which would result in a high quality conventional synthetic turf with high wear resists—may provide too much, and slightly directional, slide if used for an overfilled, simulated clay surface.

SUMMARY OF THE INVENTION

The present invention aims to provide a simulated clay tennis surface with good playing characteristics. The invention also relates to a line construction for such courts.

The present invention provides a simulated clay tennis surface, including

- a first region of the tennis surface having a flexible backing sheet which is tufted with a plurality of synthetic ribbons extending upwards of backing sheet by a first distance,
- a second region of the tennis surface having a flexible backing sheet which is tufted with a plurality of synthetic ribbons, said synthetic ribbons in the second region being longer than the ribbons in the first region so that they extend upwards of the backing sheet by a second distance which is longer than said first distance,
- a granular infill material filling the voids between the ribbons in the respective regions, said infill material being applied to a depth greater than said first distance but less than or substantially equal to said second distance so that the ribbons in the fist region are covered by an exposed layer of said infill material and the uppermost portions of the ribbons in the second region are exposed to form court markings of a contrasting colour to said infill material.

A further form of the invention provides a method of forming a simulated clay tennis court having a playing area and line markings including the steps of:

- providing a tennis surface having a flexible backing sheet which is tufted in a first region corresponding to the playing area of the court with a plurality of synthetic ribbons extending upwards of the backing sheet by a first distance, and tufted in a second region corresponding to the line markings with a plurality of synthetic ribbons longer than the ribbons in the first region so that they extend upwards of the backing sheet by a second distance which is longer than said first distance,
- laying said tennis surface on a supporting surface, and
- applying to the tennis surface a granular infill material filling the voids between the ribbons in the respective regions, said infill material being applied and levelled to a depth greater than said first distance but less than or substantially equal to said second distance so that the ribbons in the first region are covered by an exposed layer of said infill material and the uppermost portions of the ribbons in the second region are exposed to form said line markings of a contrasting colour to said infill material.

Preferably, the ribbons of adjacent portions of the first and second regions are tufted into the same sheet of flexible backing sheet.

Preferably, the ribbons in at least the first region are knit-deknit ribbons sufficiently widely spaced, preferably less than about 260 stitches per meter that upon a player sliding on the court surface there is interaction between the infill material above and within the pile.

A further form of the invention provides a simulated clay tennis surface, including

- a playing area of the tennis surface having a flexible backing sheet which is tufted with a plurality of synthetic ribbons extending upwards of the backing sheet, and voids between the ribbons,
- a granular infill material filling the voids between the ribbons, said infill material being applied to a depth greater than the height of said ribbons in the playing area so that said ribbons are covered by an exposed layer of said infill material,
- wherein the ribbons of the playing area are tufted at a low stitch density such that there is substantial interaction between the infill material in said voids and the infill material of said exposed layer when a player slides on said tennis surface.

BRIEF DESCRIPTION OF THE DRAWINGS

Further preferred embodiments will now be described with reference to the accompanying FIGURE, in which.

DETAILED DESCRIPTION OF PREFERRED EMBODIMENT

Figure 1:
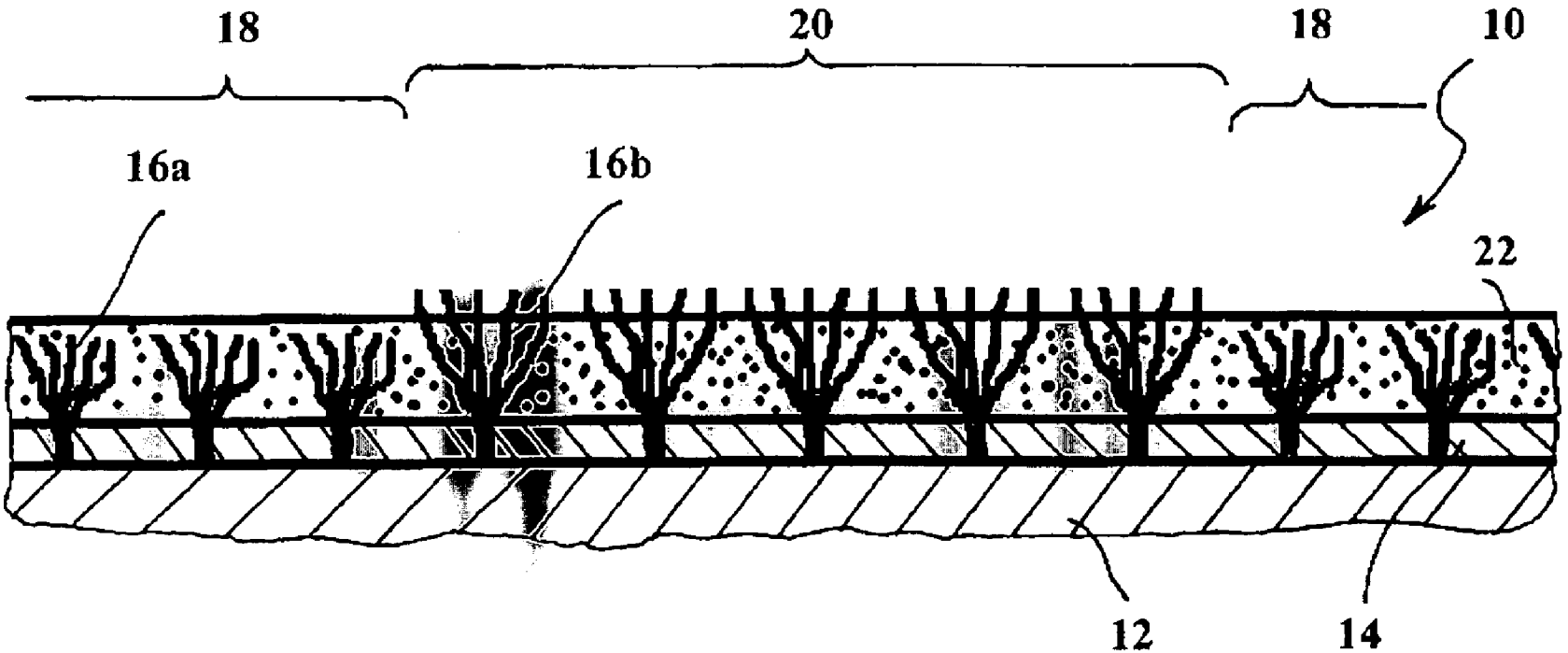
FIG. 1 is a schematic cross-section of a tennis court surface according to a preferred embodiment.

With reference to FIG. 1, the tennis surface 10 is laid on a supporting surface 12 such as the ground or a substrate of timber, concrete, bitumen or prepared rock. The supporting surface is preferably porous to allow water permeability though the substrate.

The simulated clay tennis surface has a microporous backing sheet 14 of one or more layers, of the type typically used in manufacture of conventional synthetic turf, e.g. a woven polypropylene material.

Parallel rows of synthetic ribbons 16 are tufted into the backing layer at a relatively open stitch rate of about 210–260 stitches per meter, and a gauge of about 3/16" to 3/8".

The surface 10 has first 18 and second 20 regions, forming the playing area and/or surrounds, and the court markings respectively.

The ribbons 16*a* in the fist region 18 preferably are relatively short compare to those used in conventional high quality tennis surfaces, for example about 5 mn to 10 mm.

The ribbons 16*b* in the second region 20 are longer, extending approximately 1 mm to 3 mm higher than the first region, preferably about 1.5 mm, and are of a contrasting colour to at least the infill material 20.

The particulate infill material 22, e.g. sand, is of consistent grain size and is coloured for example terracotta or green to match the appearance of the court-type which is being simulated.

The infill material is applied to a depth which completely covers the pile in the first region, which is the main playing area and surrounds of the tennis court, and levelled off at or just below the level of the longer ribbons in the second region. These longer ribbons therefore have their tips exposed to form the contrasting colour, preferably white, visible lines on the tennis court.

In this way, the longer ribbons in the second region may be used as a guide for levelling of the infix in the main playing region, and the lines are thereby pre-formed in the court. Also, by having the court markings 20 tufted into the same continuous piece of backing sheet as the adjacent playing area 18, the cutting and seaming required for installation of the court is minimised. The court material may therefore be supplied in a conventional roll width, e.g. 3.7 m, with the lines preformed. The court material may thus be supplied as a tennis court kit comprising a plurality of rolls each with pre-formed line markings corresponding to a specific part of the court, so that when the material rolls are laid out side by side and fixed in proper alignment they form a tennis court complete with line makings.

The ribbons in the first region are preferably of a colour substantially matching the infill, so that slide marks where the ribbons are temporarily uncovered will also look like clay court.

The ribbons in at least the first region are preferably formed of knit-deknit strand, which is strand which has been deformed by knitting and then unravelling before tufting into the backing sheet. When the strand is tufted into the backing sheet and cut, the strand revert to tire deformed state so that the turfs twist and curl in substantially random directions. Knit-deknit strand is commercially available, and known for use in conventional synthetic turf. However, the properties which make knit-deknit strand suitable for some applications in conventional turf—notably the increased coverage of the backing sheet—are not applicable to the simulated clay courts as the strands completely covered The ribbons in the second region preferably have similar characteristics to those in the first region, to ensure consistent playing characteristics on all regions of the court.

Surprisingly, however, the applicant has found hat knit-deknit strand provides an appropriate degree of holding of the infill, allowing the court to exhibit a similar slide characteristic to clay, without excessive or directional slip.

Surprisingly also, the applicant has found that the simulated clay surfaces benefit from a relatively open stitch rate, for example a 3/16 inch to 3/8 inch gauge and stitch rate of about 210–260 stitches per meter. Whilst an open stitch rate would rest in an inferior quality in a conventional synthetic turf, the applicant has found that in simulated clay this promotes frictional interaction between the covering layer of infill and the infill trapped in the voids between the ribbons, so that the correct amount of slide can be controlled.

Furthermore, the Applicant has found the invention allows the use of a relatively short pile length without significantly shortening the useful life of the surface as would be the case with conventional artificial turf. The Applicant believes that this extended life is due to the upper layer of infill material in the overfilled surface protecting the ribbons from wear and ultraviolet exposure. Therefore, a pile length of 5–12 mm, most preferably 5–10 mm, may usefully be employed, with consequent reduction in manufacturing cost, and also reduced transport costs due to the smaller roll diameter and lower volume of infill material required.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein. It will further be understood that any reference herein to known prior art does not, unless the contrary indication appears, constitute an admission that such prior art is commonly known by those skilled in the art to which the invention relates.

The invention claimed is:

1. A simulated clay tennis surface comprising:

a flexible backing sheet;

a playing area defined by a first plurality of synthetic ribbons and granular infill material of a first color, said first plurality of synthetic ribbons extending upwards of said backing sheet by a first distance, and said granular infill material filled to a depth above said first distance; and court line markings disposed adjacent to said playing area, said court line markings defined by a second plurality of synthetic ribbons and said granular infill material, said second plurality of synthetic ribbons extending upwards of said backing sheet by a second distance that is longer than said first distance, wherein at least portions of said second plurality of synthetic ribbons that extend above said granular infill material are a second color that contrasts with said first color of said granular infill material to provide for visual demarcation between said court line markings and said playing area.

2. A simulated clay tennis surface according to claim 1, wherein:

said first plurality of synthetic ribbons and said second plurality of synthetic ribbons are tufted into said backing sheet.

3. A simulated clay tennis surface according to claim 1, wherein:

said second distance is approximately 1 mm to 3 mm longer than said first distance.

4. A simulated clay tennis surface according to claim 3, wherein:

said second distance is approximately 1.5 mm longer than said first distance.

5. A simulated clay tennis surface according to claim 1, wherein:

said granular infill material is applied to a depth substantially equal to said second distance.

6. A simulated clay tennis surface according to claim 5, wherein:

said second plurality of synthetic ribbons serve as a level guide for said granular infill material.

7. A simulated clay tennis surface according to claim 1, wherein:

said first color of said first plurality of synthetic ribbons and said infill material comprises a terracotta color.

8. A simulated clay tennis surface according to claim 1, wherein:

said first color of said first plurality of synthetic ribbons and said infill material comprises a green color.

9. A simulated clay tennis surface according to claim 1, wherein:

said second color of said second plurality of synthetic ribbons comprises a white color.

10. A simulated clay tennis surface according to claim 1, wherein:

said first distance is between 5 and 12 mm.

11. A simulated clay tennis surface according to claim 1, wherein:

said first plurality of synthetic ribbons are formed of knit-deknit yarn.

12. A simulated clay tennis surface according to claim 11, wherein:

said first plurality of synthetic ribbons have a stitch rate of less than about 260 stitches per meter.

13. A simulated clay tennis surface according to claim 11, wherein:

said first plurality of synthetic ribbons have a stitch rate of about 210–260 stitches per meter and a stitch gauge of about 3/16 to 3/8 inches.

* * * * *